US010316611B2

(12) United States Patent
Wutherich

(10) Patent No.: US 10,316,611 B2
(45) Date of Patent: Jun. 11, 2019

(54) HYBRID BRIDGE PLUG

(71) Applicant: Kevin David Wutherich, Pittsburgh, PA (US)

(72) Inventor: Kevin David Wutherich, Pittsburgh, PA (US)

( * ) Notice: Subject to any disclaimer, the term of this patent is extended or adjusted under 35 U.S.C. 154(b) by 179 days.

(21) Appl. No.: 15/674,589

(22) Filed: Aug. 11, 2017

(65) Prior Publication Data

US 2017/0342798 A1 Nov. 30, 2017

Related U.S. Application Data

(60) Provisional application No. 62/379,103, filed on Aug. 23, 2016.

(51) Int. Cl.

| | |
|---|---|
| ***E21B 33/129*** | (2006.01) |
| ***E21B 33/12*** | (2006.01) |
| ***E21B 33/134*** | (2006.01) |
| *E21B 43/116* | (2006.01) |

(52) U.S. Cl.

CPC ..... *E21B 33/1208* (2013.01); *E21B 33/129* (2013.01); *E21B 33/134* (2013.01); *E21B 43/116* (2013.01)

(58) Field of Classification Search

CPC .. E21B 33/1208; E21B 33/129; E21B 33/134; E21B 43/116

See application file for complete search history.

(56) References Cited

U.S. PATENT DOCUMENTS

| | | | |
|---|---|---|---|
| 4,673,039 | A | 5/1987 | Mohaupt |
| 5,479,986 | A | 1/1996 | Gano et al. |
| 5,526,888 | A | 6/1996 | Gazewood |
| 5,607,017 | A | 3/1997 | Owens et al. |
| 5,685,372 | A | 11/1997 | Owens |
| 5,765,641 | A | 6/1998 | Shy et al. |
| 5,826,661 | A | 10/1998 | Parker et al. |
| 6,041,864 | A | 3/2000 | Patel et al. |
| 6,076,600 | A | 6/2000 | Vick, Jr. et al. |
| 6,119,783 | A | 9/2000 | Parker et al. |
| 6,161,622 | A | 12/2000 | Robb et al. |
| 6,167,963 | B1 | 1/2001 | McMahan et al. |
| 6,220,350 | B1 | 4/2001 | Brothers et al. |

(Continued)

FOREIGN PATENT DOCUMENTS

EP 0775804 A2 5/1997

*Primary Examiner* — Yong-Suk Ro

(74) *Attorney, Agent, or Firm* — Thomas M. Joseph, Esq

(57) ABSTRACT

A bridge plug for deployment in a well defined by casing has a stackable tubular body having a front portion, a middle portion, a back portion, and an internal bore extending therethrough with the front portion having a first opening in fluid communication with the internal bore and the back portion having a second opening in fluid communication with the internal bore. The stackable tubular body has an outer configuration shaped to receive another adjacent bridge plug when the adjacent bridge plug is stacked within the well. The middle portion includes an expandable component that can frictionally engage the casing to hold the bridge plug in a fixed position within the well. The expandable component can be destroyed, at least partially, to facilitate movement of the bridge plug within the well while maintaining fluid communication between the first opening and the second opening.

20 Claims, 8 Drawing Sheets

(56) References Cited

U.S. PATENT DOCUMENTS

| | | | |
|---|---|---|---|
| 6,431,276 | B1 | 8/2002 | Robb et al. |
| 6,494,261 | B1 | 12/2002 | Pahmiyer |
| 6,581,681 | B1 | 6/2003 | Zimmerman et al. |
| 6,708,768 | B2 | 3/2004 | Slup et al. |
| 6,904,975 | B2 | 6/2005 | Horne et al. |
| 7,270,191 | B2 | 9/2007 | Drummond et al. |
| 7,380,600 | B2 | 6/2008 | Wilberg et al. |
| 7,565,929 | B2 | 7/2009 | Bustos et al. |
| 8,324,094 | B2 | 12/2012 | Endo et al. |
| 8,869,904 | B2 | 10/2014 | Jani |
| 9,163,477 | B2 | 10/2015 | Frazier |
| 9,624,751 | B2 | 4/2017 | Hern et al. |
| 2007/0251698 | A1 | 11/2007 | Gramstad et al. |
| 2007/0277979 | A1 | 12/2007 | Todd et al. |
| 2008/0105438 | A1 | 5/2008 | Jordan et al. |
| 2010/0276159 | A1 | 11/2010 | Mailand et al. |
| 2011/0042099 | A1 | 2/2011 | Williamson, Jr. et al. |
| 2011/0048743 | A1 | 3/2011 | Stafford et al. |
| 2012/0125637 | A1* | 5/2012 | Chenault ..... E21B 33/1204 166/382 |
| 2012/0125642 | A1 | 5/2012 | Chenault et al. |
| 2013/0014958 | A1 | 1/2013 | Jani |
| 2013/0112412 | A1* | 5/2013 | Frazier ..... E21B 33/134 166/298 |
| 2014/0262344 | A1* | 9/2014 | Standridge ..... E21B 33/134 166/382 |
| 2015/0285026 | A1 | 10/2015 | Frazier |

* cited by examiner

HYBRID BRIDGE PLUG

CROSS REFERENCE TO RELATED APPLICATION

This application claims the benefit under 35 U.S.C. § 119(e) of U.S. Provisional Application No. 62/379,103 entitled "PARTIALLY DISSOLVABLE BRIDGE PLUG AND METHOD FOR HYDRAULIC FRACTURE ISOLATION" filed Aug. 23, 2016, which is incorporated herein by reference.

BACKGROUND

The drilling of wells and, in particular, hydrocarbon wells can involve complications that make the process time consuming and expensive. In recognition of these complications and expenses, added emphasis has been placed on increasing efficiencies associated with well completion and with maintenance over the life of the well. Over the years, ever increasing well depths and sophisticated well architectures have made the need to obtain reductions in time and effort spent in completions and maintenance operations even greater.

Perforating and fracturing applications in a cased well, generally during well completion, constitute areas where significant amounts of time and effort are spent. This is particularly true in wells that have increased depth and sophisticated architecture. These applications can involve the positioning of a bridge plug downhole of a well section that is to be perforated and to be fractured. Positioning of the bridge plug may be aided by pumping a driving fluid through the well. Some bridge plugs can be bull-nosed.

A conventional bridge plug can be run down a well on a pipe or on a wire. When run on wire, the bridge plug can be dropped down by gravity through vertical shafts and driven by fluid in horizontal sections. When run on a pipe, the plug can be pushed from surface. Once the bridge plug reaches the desired depth/position, an electrical charge is sent down the pipe and/or wire to cause an explosion. The explosion causes a piston to compress the plug, so that slips extending therefrom, frictionally engage the surface of casing that defines the well. Next, a packer can seal the plug. Optionally, a ball is dropped down through the pipe or through the well to seal everything in pressure isolation.

Once in place, equipment at the oilfield surface may communicate with the plug assembly over conventional wireline to direct the setting of the plug. Once anchored and sealed, a perforation application may take place above the bridge plug so as to provide perforations through the casing in the well section. Similarly, a fracturing application directing fracture fluid through the casing perforations and into the adjacent formation may follow. This process may be repeated, generally starting from the terminal end of the well and moving uphole section by section, until the casing and formation have been configured and treated as desired.

The presence of the set bridge plug in below the well section as indicated above keeps the high pressure perforating and fracturing applications from affecting well sections below the plug. Conventional bridge plugs can be made from inexpensive cast iron, composite materials, or fully-dissolvable materials. Cast iron plugs have a high "drill-out" cost when such plugs must be removed. Composite bridge plugs have higher initial costs and lower drill-out costs. Fully-dissolvable plugs are more expensive, but have lower drill-out costs when such plugs are removed through "clean-out" operations. As a result, there is a need for an improved bridge plug.

SUMMARY

The following summary is provided to introduce a selection of concepts in a simplified form that are further described below in the detailed description. This summary is not intended to identify key features or essential features of the claimed subject matter, nor is it intended to be used to limit the scope of the claimed subject matter.

In various implementations, a bridge plug for deployment in a well defined by casing has a stackable tubular body having a front portion, a middle portion, a back portion, and an internal bore extending therethrough with the front portion having a first opening in fluid communication with the internal bore and the back portion having a second opening in fluid communication with the internal bore. The stackable tubular body has an outer configuration shaped to receive another adjacent bridge plug when the adjacent bridge plug is stacked within the well. The middle portion includes an expandable component that can frictionally engage the casing to hold the bridge plug in a fixed position within the well. The expandable component can be destroyed, at least partially, to facilitate movement of the bridge plug within the well while maintaining fluid communication between the first opening and the second opening.

These and other features and advantages will be apparent from a reading of the following detailed description and a review of the appended drawings. It is to be understood that the foregoing summary, the following detailed description and the appended drawings are explanatory only and are not restrictive of various features as claimed.

DETAILED DESCRIPTION

The detailed description provided below in connection with the appended drawings is intended as a description of examples and is not intended to represent the only forms in which the present examples can be constructed or utilized. The description sets forth functions of the examples and sequences of steps for constructing and operating the examples. However, the same or equivalent functions and sequences can be accomplished by different examples.

References to "one embodiment," "an embodiment," "an example embodiment," "one implementation," "an implementation," "one example," "an example" and the like, indicate that the described embodiment, implementation or example can include a particular feature, structure or characteristic, but every embodiment, implementation or example can not necessarily include the particular feature, structure or characteristic. Moreover, such phrases are not necessarily referring to the same embodiment, implementation or example. Further, when a particular feature, structure or characteristic is described in connection with an embodiment, implementation or example, it is to be appreciated that such feature, structure or characteristic can be implemented in connection with other embodiments, implementations or examples whether or not explicitly described.

Numerous specific details are set forth in order to provide a thorough understanding of one or more features of the described subject matter. It is to be appreciated, however, that such features can be practiced without these specific details. While certain components are shown in block diagram form to describe one or more features, it is to be understood that functionality performed by a single component can be performed by multiple components. Similarly, a single component can be configured to perform functionality described as being performed by multiple components.

Figure 1A:
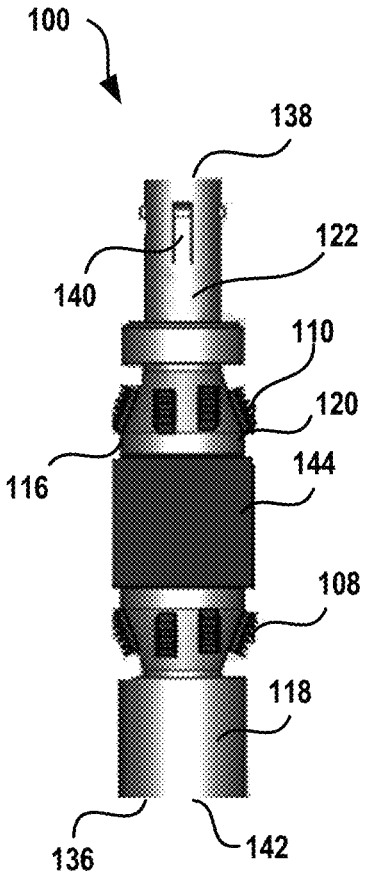
FIG. 1A is a side elevation view illustrating a hybrid bridge plug that illustrates an embodiment of the invention.
Figure 1B:
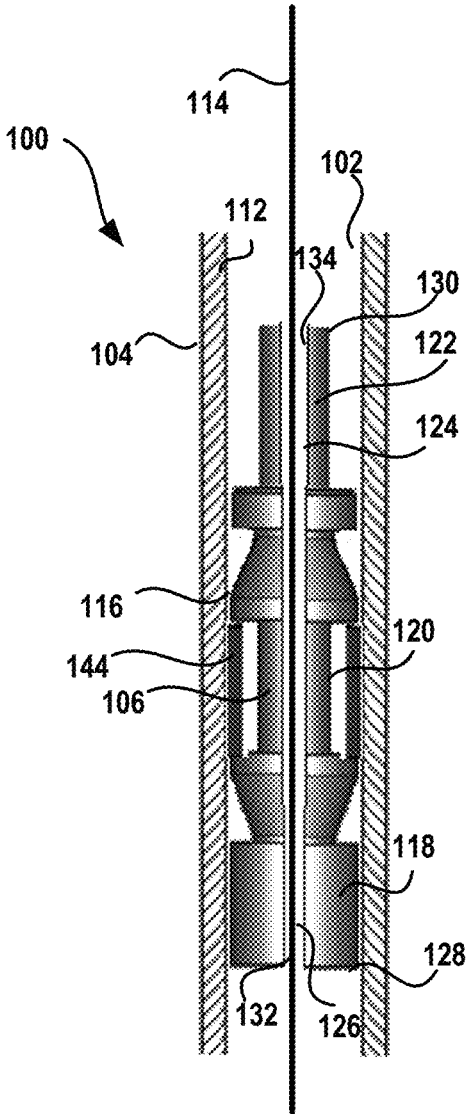
FIG. 1B is a sectional view in side elevation illustrating the hybrid bridge plug shown in FIG. 1A in a well that is defined by casing that illustrates an embodiment of the invention.

Referring to FIGS. 1A-1B, various features of the subject disclosure are now described in more detail with respect to a hybrid bridge plug, which is generally designated by the numeral 100, positioned within a well 102 that is defined by casing 104. The hybrid bridge plug 100 can include components or elements, which will be described in more detail below, that expand to engage an abutting surface.

Once the components or elements are expanded, the hybrid bridge plug 100 grips the abutting surface and is held in a fixed position. Then, certain components or elements of the hybrid bridge plug 100 are destroyed, at least partially. If the components or elements are made from dissolvable materials, the components or elements begin to dissolve as soon as the hybrid bridge plug 100 is run in the well 102.

It should be understood that the destruction of the components or elements can begin even before a fracking operation begins. In some embodiments, the hybrid bridge plug 100 must maintain integrity at least until the end of a fracking stage. In such embodiments, the fracking operation can maintain a differential pressure of at least 1000 psi for 3-12 hours after the hybrid bridge plug 100 is set and the components or elements are expanded. The dissolution of the components or elements can take as little as twelve hours, more than two hundred hours, or, in some embodiments, between twelve to two hundred hours.

Upon destruction of the components or elements, which usually occurs after a fracturing operation has been completed, the hybrid bridge plug 100 is free to move along horizontally or vertically through the well 102.

The hybrid bridge plug 100 is essentially a conventional bridge plug with a seal 144 and a two sets of slips 108-110 positioned in a predetermined spaced-apart relationship with the seal 106. The seal 106 and, optionally, the slips 108-110 are elements that can engage, frictionally, a surface 112 of casing 104 to hold the hybrid bridge plug 100 in place within the well 102. Once the seal 106 and, optionally, the slips 108-110 have been destroyed, the hybrid bridge plug 100 can move, freely or with minimal force, along an axis 114 within the well 102.

The hybrid bridge plug 100 has a stackable tubular body 116 that includes a front portion 118, a middle portion 120, and a back portion 122. An internal bore 124 extends through the front portion 118, the middle portion 120, and the back portion 122 forming an essentially axial flow channel 126 that allows fluid to flow from one end 128 of the body 116 to the opposite end 130.

The tubular body 116 can retain integrity for a minimum of several weeks and up to an indefinite length of time (i.e., it does not dissolve or significantly degrade before a well clean-up operation occurs). As a result, the tubular body 116 can be retrieved or re-used, if so desired. Since the tubular body 116 is not made of a material that can be destroyed during the clean-up operation, the material costs are minimized. In some embodiments, the ability to retrieve the hybrid bridge plug 100 is limited by the size of a lubricator (not shown).

The front portion 118 includes an opening 132 at the end 128. The back portion 122 includes an opening 134 at the end 130. The openings 132-134 are in fluid communication with the flow channel 126 to allow fluid to flow through the hybrid bridge plug 100.

The hybrid bridge plug 100 can form stacks, with other hybrid bridge plugs. In such exemplary embodiments, the flow channel 126 forms a continuous and sealed flow channel within the stack. The flow channel 126 can be used to circulate fluid therethrough.

Figure 3:
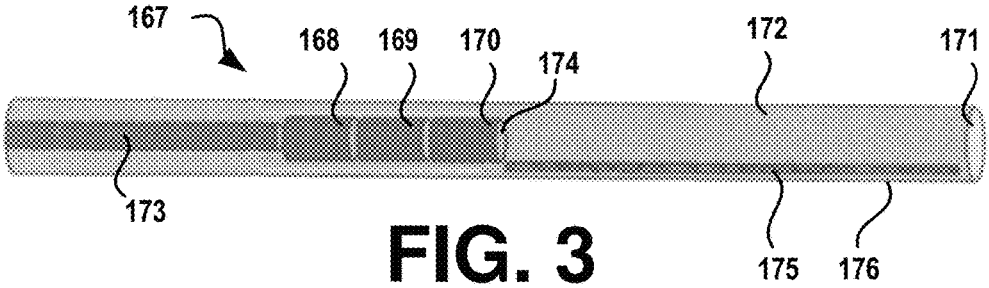
FIG. 3 is a schematic diagram of a plurality of stacked hybrid bridge plugs connected to one another within a well that is defined by casing in accordance with the described subject matter.
Figure 4:
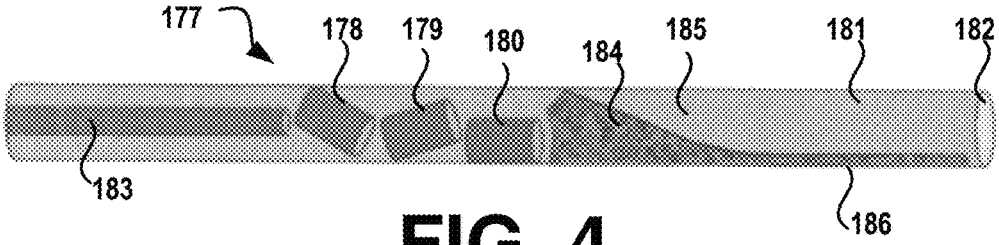
FIG. 4 is a schematic diagram of a plurality of stacked conventional bridge plugs connected to one another within a well that is defined by casing in accordance with the described subject matter.

The ability to circulate fluid through a continuous flow channel allows fluid to flow through toe of a plug stack to allow for the retrieval of the hybrid bridge plug 100 within the well 102. In some embodiments, sand and other debris can be cleaned out of the well 102 as the hybrid bridge plug 100 travels to the base of the well 102, which is shown in FIG. 3 Without the continuous flow channel 126, sand and debris could pile up in front of the hybrid bridge plug 100 as it travels through the well, which can limit the movement of the hybrid bridge plug 100 within the well 102, which is shown in FIG. 4.

The front portion 118 can have an outer configuration 136 shaped to receive a rear portion of another adjacent bridge plug to form plug stacks. The back portion 122 can have an outer configuration 138 shaped for insertion into a front portion of another adjacent bridge plug when the adjacent bridge plug is stacked. It should be understood that the front portion 118 and the back portion 122 can be reversed, so that the male part can be on the front portion 118 or on the back portion 122.

The hybrid bridge plug 100 can include a latching component including latching mechanism 140 at the end 130 that can latch onto another bridge plug and a receptacle 142 configured to receive a latching mechanism that is similar to or identical to the latching mechanism 140 at the end 128. The latching mechanism 140 and the receptacle 142 can facilitate the formation of plug stacks.

The latching mechanism 140 can be releasable. The latching mechanism 140 can be configured to release mechanically and/or electronically through the use of a conventional triggering device. The latching mechanism 140 can be configured to actuate and/or to release with a ball drop.

The middle portion 120 can include an expandable component 144 that is incorporated into the seal 106 that can expand to frictionally engage casing 104 to hold the hybrid bridge plug 100 in a fixed position within the well 102. The expandable component 144 can be destroyed, at least partially, to facilitate movement of the hybrid bridge plug 100 within the well while maintaining fluid communication between the openings 132-134, so that the flow channel 126 maintains its integrity.

The expandable component 144 can be destroyed, fully or partially, through any suitable mechanical, chemical, and/or electrical means. In this exemplary embodiment, the expandable component 144 is dissolved, at least partially, to facilitate movement of the hybrid bridge plug 100 within the well 102 while maintaining fluid communication between the openings 132-134. The expandable component 144 can be 'dissolvable' in the sense that certain features thereof may be configured for passive degradation, dissolution upon exposure to downhole well conditions, or through intentional exposure to preselected solvents. Alternatively, the expandable component 144 can include a brittle material that can be destroyed by mechanical stress.

In this exemplary embodiment, the expandable component 144 and, optionally, the slips 108-110, or any other component that is used to lock the hybrid bridge plug 100 in place in the well 102 has sufficient integrity to complete a single stage of a fracturing operations. Once the stage is complete, which typically occurs within 4-6 hours of deployment, the condition of the expandable component 144, the slips 108-110, or other similar component changes, such that the components cannot support a differential pressure on the hybrid bridge plug 100 for more than four days. At that point, the hybrid bridge plug 100 can move freely and be pushed or pulled within the well 102 with minimal force.

The expandable component 144 and/or the slips 108-110 can be partially or fully dissolving. The expandable component 144 and/or the slips 108-110 can include sub-structures that are partially or fully dissolvable. In some embodiments, the slips 108-110 can be made, partially, of dissolvable material, in which sufficient material is dissolved such that slips 108-110 lose integrity while the non-dissolvable material of the slips 108-110 can be circulated back to surface.

The expandable component 144 and/or the slips 108-110 can shatter upon impact of the hybrid bridge plug 100. In other embodiments, the slips 108-110 can retract when the latching mechanism 140 is actuated to the hybrid bridge plug 100 to another object.

The hybrid bridge plug 100 and its components can be made from any suitable material through any suitable manufacturing method. Suitable materials include flexible, semi-flexible, rigid, or semi-rigid materials. Suitable materials also include metals, ceramics, plastics, and composites. In this exemplary embodiment, the body 116, preferably, is made from metallic or composite materials. The expandable component 144 and/or the slips 108-110 can be made from a metallic material, such as a magnesium based material, or an elastomeric material, such as a polylactic acid.

Figure 2:
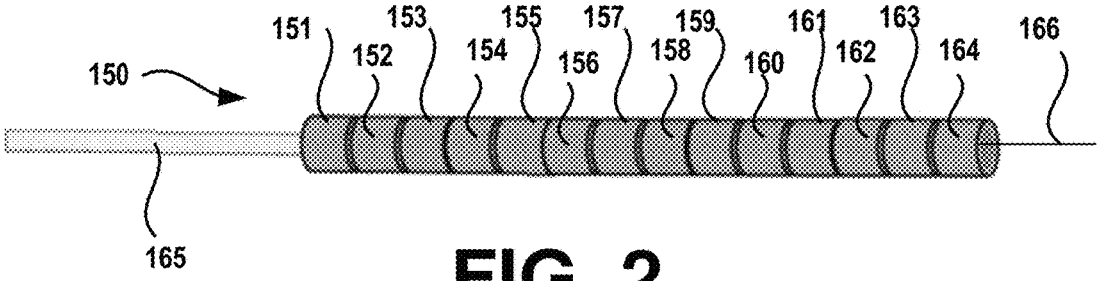
FIG. 2 is a schematic diagram of a plurality of stacked hybrid bridge plugs connected to one another in accordance with the described subject matter.

Referring to FIG. 2, a stack, generally designated by the numeral 150, of stackable hybrid bridge plugs, generally designated by the numerals 151-164, are shown in accordance with the disclosed subject matter. The hybrid bridge plugs 151-164 are connected to one another in series. A coiled tube or stick pipe 165 can connect to the hybrid bridge plug 151 to push and/or to pull the plug stack 150 along an axis 166.

The plug stack 150, generally, is formed once the hybrid bridge plug 151 is free to move. The coiled tubing or stick pipe 150 can be sent down a well to tag and to latch onto the hybrid bridge plug 151 to form the plug stack 150. The coiled tubing or stick pipe 165 can connect to and/or latch onto the hybrid bridge plug 151 after the hybrid bridge plug 151 has been disengaged from any abutting surfaces.

In some embodiments, the coiled tubing or stick pipe 165 can include a receptacle or apparatus attached to its end, to latch on to the plug 151. The receptacle or apparatus would be configured in a similar manner as a receiving end on the plug 151. The coiled tubing or stick pipe 165 could include an additional mechanism to detach the plug stack 150 therefrom. The mechanism can be a ball drop disconnect, such as the FDL Hydraulic Disconnect tool disclosed in U.S. Pat. No. 5,526,888 or any other conventional disconnect device.

Once the hybrid bridge plug 151 is moved by the coiled tubing or stick pipe 165, the hybrid bridge plug 151 can connect and/or latch onto hybrid bridge plug 152. These steps can be repeated with hybrid bridge plugs 153-164 until the plug stack 150 is formed. Since the hybrid bridge plug 151 is free moving, the coiled tubing or stick pipe 165 can continue to run to the bottom of a well.

While the coiled tubing or stick pipe 150 runs to the bottom, fluid and sand can be circulated through the plug stack 150 to allow for sand clean-up. In some embodiments, fluids and sand can be reverse circulated. In other embodiments, fluids such as friction reducers and gels can be run in the event that the plug stack 150 becomes stuck within the well. Alternatively, acids or heated brine can be circulated or reverse circulated to encourage dissolution and/or destruction of elements or components of the plug stack 150 that were not fully dissolved when the plug stack 150 was formed. Once all hybrid bridge plugs 151-164 are captured by the plug stack 150, the hybrid bridge plugs 151-164 can be run to a "rat-hole" at the toe of a well. A rat hole is an extra hole drilled at the bottom of a well to leave expendable completion equipment, such as the carriers for perforating guncharges. Rat holes are formed by drilling a well deeper than is required to provide room for placing debris in the well, such as disposed plugs.

The plug stack 150 can be deposited at the bottom of the well for permanent disposal while the coiled tubing or stick pipe 150 is run back to the well surface. In some embodiments, it will be necessary to drill additional "rat hole" to dispose of the hybrid bridge plugs 151-164.

Referring to FIGS. 3-4 with continuing reference to the foregoing figures, another plug stack, generally designated by the numeral 167, in accordance with the disclosed subject matter is shown. Like the embodiment shown in FIG. 2, the plug stack 167 is formed by connecting a plurality of hybrid bridge plugs 168-170 to one another. In this exemplary embodiment, the plug stack 167 is formed within a well 171 defined by casing 172

Like the embodiment shown in FIG. 2, the plug stack 167 is formed by connecting the hybrid bridge plug 168 to a coiled tube or stick pipe 173 within the well 171. The coiled tubing or stick pipe 173 engages the hybrid bridge plug 168 after certain components or elements of the hybrid bridge plug 168 that were engaging the well casing 54 are destroyed to allow the hybrid bridge plug 168 to move, freely, within the well 171. In this exemplary embodiment, the coiled tubing or stick pipe 173 latches onto the hybrid bridge plug 168.

After the coiled tubing or stick pipe 173 connects to the hybrid bridge plug 168, the coiled tubing or stick pipe 173 can push the hybrid bridge plug 168 through the well 171 to engage the hybrid bridge plug 169. Then, the hybrid bridge plug 169 can engage the hybrid bridge plug 170 to form the plug stack 167.

The hybrid bridge plugs 168-170 are stackable, so that they form a continuous flow channel 174 that extends through the plug stack 167 and, optionally, the coiled tubing or stick pipe 173. Typically, sand 175 accumulates at a bottom surface 176 of the well 171 upon completion of fracking operations.

The continuous flow channel 174 allows for the removal of the sand 175 by circulating fluid (i.e., pumping fluid down the coiled tubing or stick pipe 173). The fluid travels back up to surface of the well 171 through the coiled tubing or stick pipe 173 and casing annulus for the well 171. Alternatively, the fluid can be reverse circulated by pumping fluid from above ground down the annulus and back up to the ground through the coiled tubing or stick pipe 173.

In contrast, a conventional agglomeration, generally designated by the numeral 177, of conventional bridge plugs, generally designated by the numerals 178-180, is shown in FIG. 4. The conventional bridge plugs 178-180 are not aligned with one another within a well 181 defined by casing 182.

Unlike the embodiments of the invention shown in FIGS. 2-3, the bridge plugs 178-180 are not stackable, so that the bridge plugs 178-180 cannot connect to one another to form a continuous flow channel, like continuous flow channel 174 shown in FIG. 3. The conventional bridge plug 178 cannot engage a coiled tubing or stick pipe 183, so that fluids can flow continuously from the coiled tubing or stick pipe 183 through the bridge plugs 178-180.

As a result, sand and/or debris 184 can build up in the center 185 of the well 181 and does not remain confined to an area adjacent to a bottom surface 186 of the well 181. Consequently, the accumulation of sand and/or debris 184 at the center 185 of the well 181 prevents fluid flow through the well 181 and/or inhibit recovery of the bridge plugs 178-180.

Figure 5A:
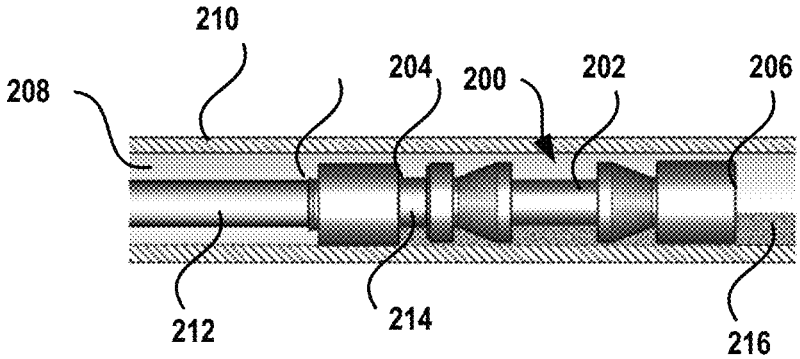
FIG. 5A is a partial sectional view in side elevation illustrating a hybrid bridge plug positioned horizontally within a well that is defined by casing that illustrates an embodiment of the invention.
Figure 5B:
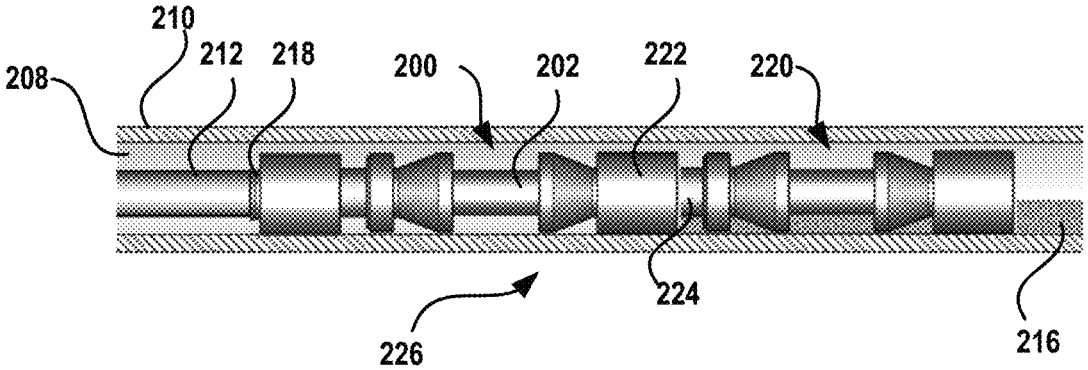
FIG. 5B is a partial sectional view in side elevation illustrating the hybrid bridge plug shown in FIG. 5A attached to another, identical hybrid bridge plug within a well that is defined by casing that illustrates an embodiment of the invention.

Referring now to FIGS. 5A-5B with continuing reference to the foregoing figures, a hybrid bridge plug, generally designated by the numeral 200, is shown. Unlike the embodiment shown in FIGS. 1A-1B, the hybrid bridge plug 200 does not include an expandable component 144 because it has been dissolved, destroyed by mechanical stress, or destroyed through some other predetermined means and/or mechanism.

Similarly, the slips 108-110 shown in FIGS. 1A-1B have been removed, so that only a hybrid bridge plug body 202 remains. The body 202 includes an intact flow channel that permits fluid to flow from one end 204 to the opposite end 206.

The hybrid bridge plug 200 is positioned horizontally within a well 208 defined by casing 210. The hybrid bridge plug 200 has the ability to move horizontally because the expandable component 144 and the slips 108-110 are not frictionally engaging casing 210.

In operation, the expandable component 144 and the slips 108-110 are destroyed to allow the body 202 to move within the well 208. A coiled tubing or stick pipe 212 is inserted to engage a front portion 214 of the hybrid bridge plug 200. The stick pipe 212 connects to the front portion 214 while maintaining the integrity of the flow channel, so that sand and/or debris 216 can be circulated into the well 208. The sand and/or debris 216 are carried by a fluid matrix. The stick pipe 212 can include a latching mechanism 218 to engage the end 204 of the hybrid bridge plug 200.

The stick pipe 212 can push the hybrid bridge plug 200 through the well 210 until it engages a second, identical hybrid bridge plug 220. A rear portion 222 of the hybrid bridge plug 200 can connect to a front portion 224 of the hybrid bridge plug 220 to form a hybrid bridge plug mini-stack 226, as shown in FIG. 5B.

The stick pipe 212 can continue to push the mini-stack 226 through the well to engage additional bridge plugs to form plug stacks, like plug stack 150 shown in FIG. 2 and/or plug stack 167 shown in FIG. 3. The mini-stack 226 will maintain a flow channel, like flow channel 174 shown in FIG. 3, until the mini-stack 226 reaches the end of the well. Alternatively, the stick pipe 212 can pull the mini-stack 226 toward the surface of the well 208, so that hybrid bridge plug 200 and/or hybrid bridge plug 220 can be removed from the well 208 for reuse.

Figure 6:
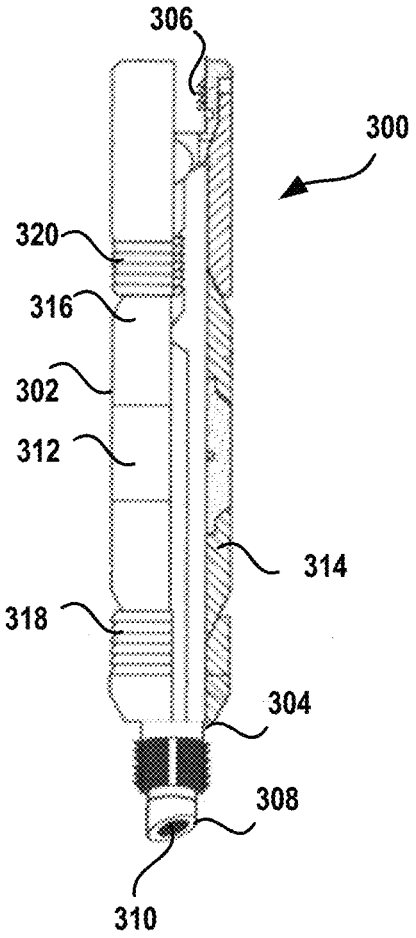
FIG. 6 is a partial sectional view in side elevation illustrating a hybrid bridge plug that illustrates another embodiment of the invention.

Referring to FIG. 6 with continuing reference to the foregoing figures, another embodiment of a hybrid bridge plug, generally designated by the numeral 300 is shown. The hybrid bridge plug 300 includes an essentially cylindrical body 302 positioned between a latching mechanism 304 and a receptacle 306. The latching mechanism 304 includes an opening 308 that is in fluid communication with a flow channel 310 that extends through the body 302 and the receptacle 306.

The body 302 includes an expandable annular seal 312 positioned between a pair of annular structural members 314-316. Slips 318 are positioned between annular structural member 314 and the latching mechanism 304. Slips 320 are positioned between annular structural member 316 and the receptacle 306.

The body 302 and the slips 318-320 can have substantially high strength and hardness (e.g. L80, P110). In one embodiment, the body 302 and the slips 318-320 are configured to withstand a pressure differential of more than about 8,000 psi to ensure structural integrity of the hybrid bridge plug 300. Thus, a standard perforating or fracturing application which induces a pressure differential of about 5,000 psi is not of significant concern. Due to the anchoring and structural integrity afforded the hybrid bridge plug 300, the body 302 and the slips 318-320 can be referred to as integrity components.

In spite of the high strength and hardness characteristics of the body 302 and the slips 318-320 can have a degradable or dissolvable nature that allows for subsequent drill-out or other plug removal techniques to be carried out in an efficient and time-saving manner. Similarly, the latching mechanism 304, the receptacle 306 and/or the expandable annular seal 312 can be degradable or dissolvable, at least partially. In some embodiments, the integrity components degrade or dissolve, partially, to maintain the structural integrity of the body 302 and the flow channel 310 to ensure that fluid can flow through the hybrid bridge plug 300.

Incorporating a degradable or dissolvable character into the integrity components can be achieved by use of reactive metal in construction. Namely, the body 302 and the slips 318-320 can be made up of a reactive metal such as aluminum with an alloying element incorporated thereinto. The alloying elements can include lithium, gallium, indium, zinc and/or bismuth. Thus, over time, particularly in the face of exposure to water, fracturing fluid, high temperatures, and other downhole well conditions, the material of the body 302 and the slips 318-320 can begin to degrade or dissolve, at least partially.

Figure 7:
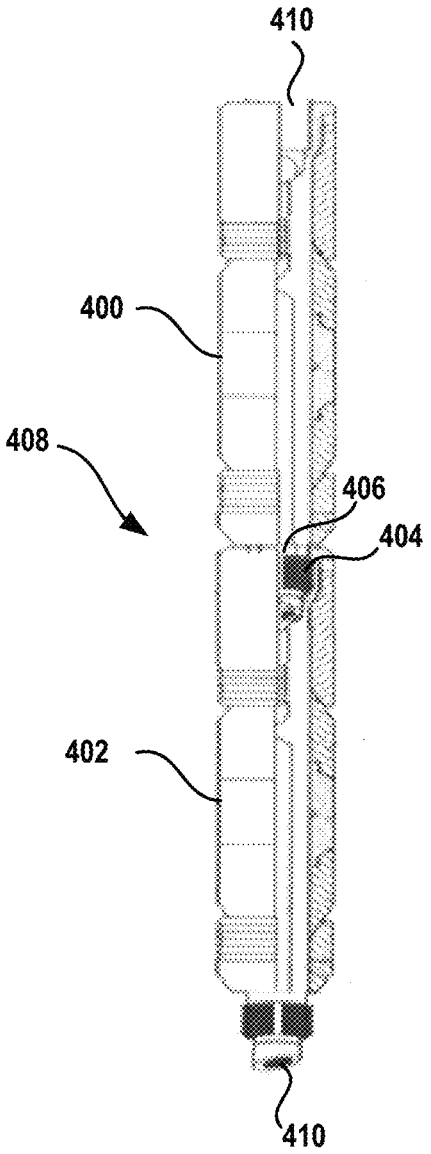
FIG. 7 is a partial sectional view in side elevation illustrating multiple hybrid bridge plugs that illustrates another embodiment of the invention.

Referring now to FIG. 7 with continuing reference to the foregoing figures, a pair of hybrid bridge plugs, generally designated by the numerals 400-402, is illustrated as an embodiment that implements features of the described subject matter. The hybrid bridge plugs 400-402 are essentially identical, structurally, to the hybrid bridge plug 300 shown in FIG. 6.

The hybrid bridge plug 400 includes a latching mechanism 404 that is essentially identical to the latching mechanism 304 shown in FIG. 6. The hybrid bridge plug 402 includes a receptacle 406 that is essentially identical to the receptacle 306 shown in FIG. 6. The latching mechanism 404 can be inserted into the receptacle 406 to connect the hybrid bridge plug 400 to the hybrid bridge plug 402. The connected hybrid bridge plugs 400-402 form a plug stack 408.

The hybrid bridge plugs 400-402, when stacked and latched together, have a continuous flow channel 410 that extends through the center. The continuous flow channel 410 can allow for the circulation of fluid around the hybrid bridge plugs 400-402 when latched to a coiled tube or stack pipe, such as the coiled tube or stack pipe 212 shown in FIGS. 5A-5B.

Figure 8A:
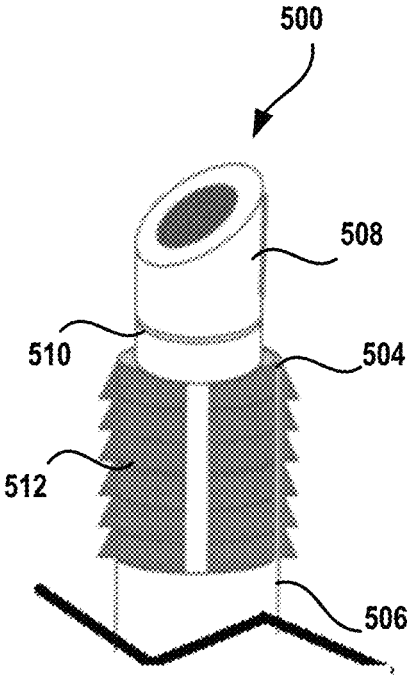
FIG. 8A is a fragmentary perspective view of a section of a hybrid bridge plug illustrating a receptacle that illustrates features of the disclosed subject matter.
Figure 8B:
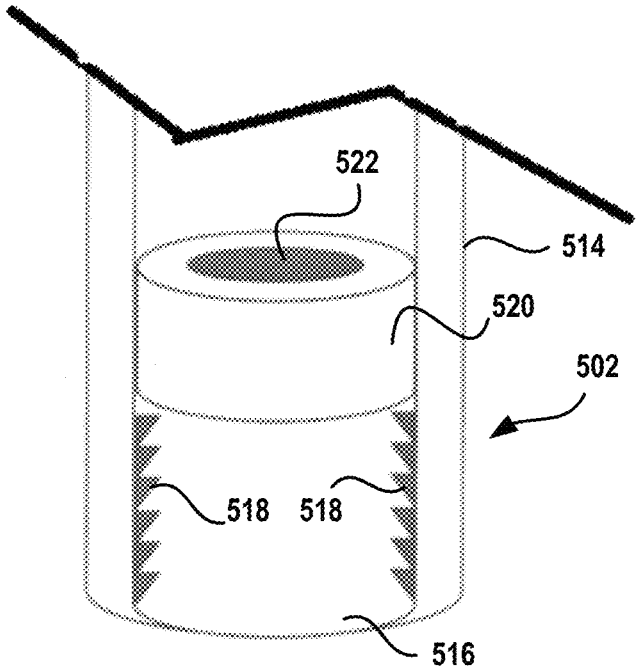
FIG. 8B is a fragmentary perspective view of a section of a hybrid bridge plug illustrating a latching mechanism that illustrates features of the disclosed subject matter.

Referring now to FIGS. 8A-8B with continuing reference to the foregoing figures, a latching mechanism, generally designated by the numeral 500, and a receptacle, generally designated by the numeral 502, is shown. The latching mechanism 500 can extend from a back portion of a hybrid bridge plug in the same manner as the latching mechanism 404 shown in FIG. 7. The receptacle 502 can extend from the front portion of a hybrid bridge plug in the same manner as the receptacle 406 shown in FIG. 7.

The latching mechanism 500 has an essentially cylindrical tubular body 504 with a thicker annular section 506 at one end and a thinner annular section 508 at the opposite end 508. The thinner annular section 508 can include an o-ring 510. The thicker annular section 306 can include a plurality of spring loaded dogs 512 to engage the receptacle 502. The transition from the thinner annular section 508 to the thicker annular section 506 can be gradual, continuous, discrete, and/or tapered.

The receptacle 502 can have an essentially cylindrical, tubular body 514 with an open internal chamber 516 contoured to receive the latching mechanism thinner annular section 508. The internal chamber 516 can include a plurality of engaging surfaces 518 for frictionally engaging the spring loaded dogs 512 when the latching mechanism 500 connects to the receptacle 502.

The receptacle 502 can include a ball seat 520 that engages the thinner annular section 508 when it penetrates the internal chamber 516. The ball seat 520 can include a latch-in-seal 522. It should be understood that the latching mechanism 500 and the receptacle 502 can include mechanical or electrical means to release the latching mechanism 500 from the receptacle 502.

Figure 9A:
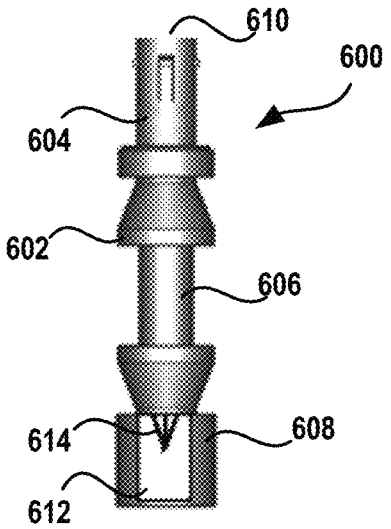
FIG. 9A is a side elevation view illustrating another hybrid bridge plug that illustrates another embodiment of the invention.
Figure 9B:
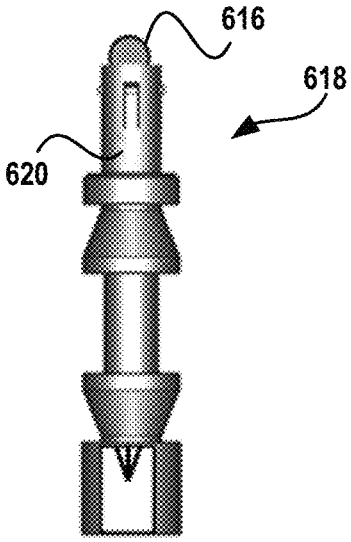
FIG. 9B is a side elevation view illustrating another hybrid bridge plug that can connect to the hybrid bridge plug shown in FIG. 9A.

Referring now to FIGS. 9A-9B with continuing reference to the foregoing figures, another embodiment of a hybrid bridge plug, generally designated by the numeral 600, is shown. The hybrid bridge plug 600 includes a stackable tubular body 602 that includes a front portion 604, a middle portion 606, and a back portion 608. An internal bore 610 extends through the front portion 604, the middle portion 606, and the back portion 608 to form an axial flow channel 612. The front portion 604 and the middle portion 606 are essentially identical to the front portion 118 and the middle portion 120 shown in FIGS. 1A-1B.

Unlike the embodiment shown in FIGS. 1A-1B, the back portion 608 can include a protrusion 614 extending therefrom. The protrusion 614 can be implemented to impact a ceramic ball 616 on a neighboring hybrid bridge plug 618 to cause the ceramic ball 616 to fracture. After fracture, fragments of the ceramic ball 616 can be circulated back to the surface of the well.

Depending on the configuration (male/female orientation, ball seat location, etc.) of a front portion 620 of the hybrid bridge plug 618 in relation to the back portion 608 of the hybrid bridge plug 600, the protrusion 614 can be positioned to contact the ceramic ball 616 without inhibiting the latching of the hybrid bridge plug 600 to the hybrid bridge plug 618. In this exemplary embodiment, the protrusion 614 will not restrict flow, severely.

Figure 10A:
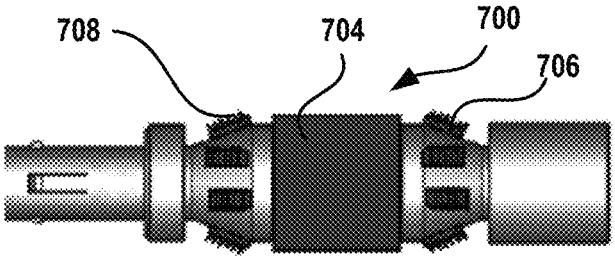
FIGS. 10A-10B are side elevation views that illustrate another hybrid bridge plug that illustrates another embodiment of the invention.
Figure 10B:
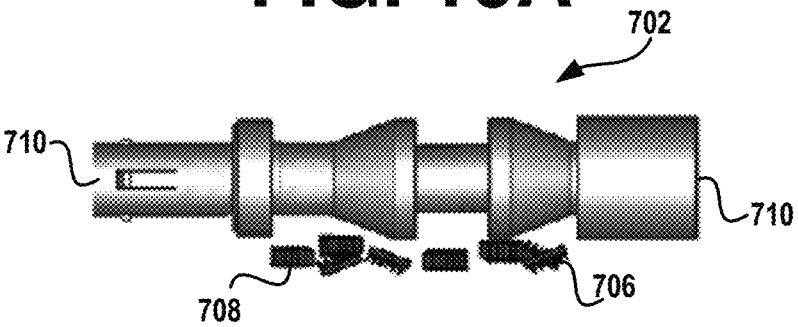

Referring now to FIGS. 10A-10B with continuing reference to the foregoing figures, another embodiment of a hybrid bridge plug, generally designated by the numerals 700 and 702, is shown. The hybrid bridge plug 700 shown in FIG. 10A represents a hybrid bridge plug as deployed with an intact expandable component 704 and two sets of slips 706-708 positioned thereon.

The hybrid bridge plug 702 shown in FIG. 10B represents a hybrid bridge plug in which the expandable component 704 shown in FIG. 10A has been destroyed, while maintaining an intact flow channel 710. In this exemplary embodiment, the slips 706-708 have been designed to fall away when the expandable component 704 has been destroyed and to circulate to the well surface for recovery. In some embodiments the slips 706-708 can include dissolvable components, such as a substrate, that can leave hardened components to circulate back to the well surface.

Figure 11:
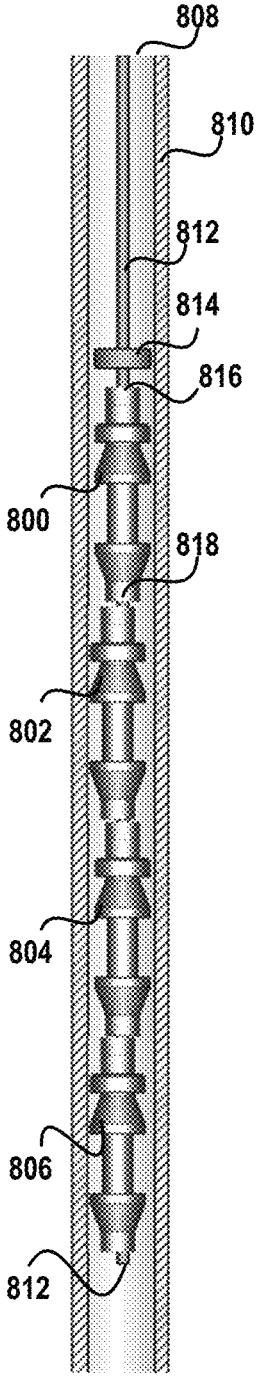
FIG. 11 is a partial sectional view in side elevation illustrating a plurality of hybrid bridge plugs positioned within a well that is defined by casing that illustrates another embodiment of the invention.

Referring now to FIG. 11 with continuing reference to the foregoing figures, a plurality of hybrid bridge plugs, generally designated by the numerals 800-806, is shown. The hybrid bridge plugs 800-806 are positioned within a well 808 defined by casing 810. The hybrid bridge plugs 800-806 are connected to one another with coiled tubing 812 that also extends through a plug stop 814. The plug stop 814 is positioned above the hybrid bridge plugs 800-806 in the well 808.

Unlike the embodiments shown in FIGS. 1A-1B, the hybrid bridge plug 800 does not include the latching mechanism 140. Rather, the hybrid bridge plug 800 includes a pair of openings 816-818 that receive the coiled tubing 812. The hybrid bridge plugs 802-806 are connected to one another in a similar manner using the coiled tubing 812.

Exemplary Processes

Figure 12:
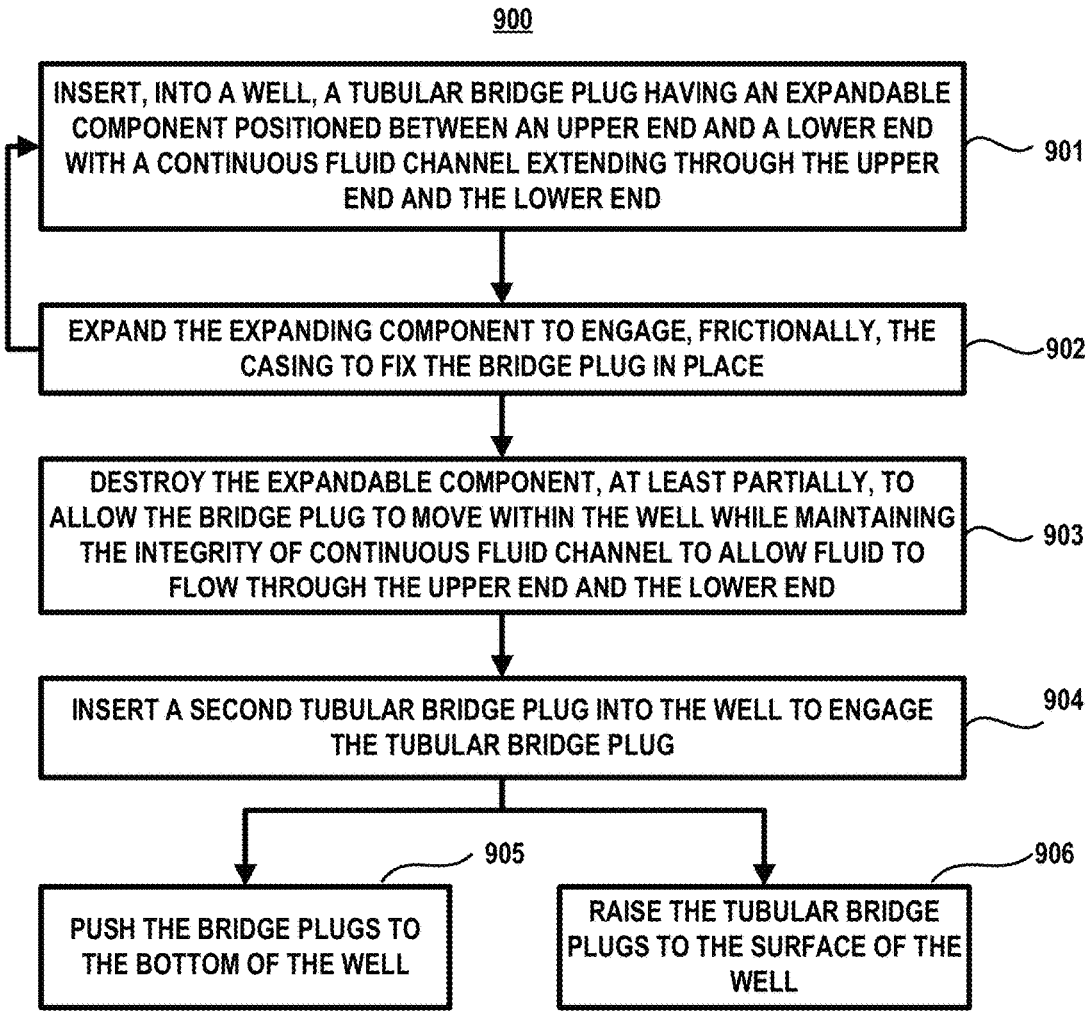
FIG. 12 illustrates an embodiment of an exemplary process in accordance with the described subject matter.

Referring to FIG. 12 with continuing reference to the foregoing figures, a method 900 is illustrated as an embodiment of an exemplary process for using bridge plugs within a well that is defined by casing in accordance with features of the described subject matter is shown. Method 900, or portions thereof, can be performed using the hybrid bridge plugs shown in FIGS. 1A-3, 5A-7, and 9A-11. For example, method 900 can be performed using the hybrid bridge plugs 100, 151-164, 168-170, 200, 220, 300, 400, 402, 600, 618, 700, and 800-808 shown in FIGS. 1A-3, 5A-7, and 9A-11.

At 901, a tubular bridge plug having an expandable component positioned between an upper end and a lower end with a continuous fluid channel extending through the upper end and the lower end is inserted into a well. In this exemplary embodiment, the hybrid bridge plug can be one of the hybrid bridge plugs 100, 151-164, 168-170, 200, 220, 300, 400, 402, 600, 618, 700, and 800-808 shown in FIGS. 1A-3, 5A-7, and 9A-11.

The expandable component can be the expandable component 144 shown in FIGS. 1A-1B, the expandable annular seal 312 shown in FIG. 6 or the expandable component 704 shown in FIG. 10A.

At 902, the expanding component is expanded to engage, frictionally, the casing to fix the bridge plug in place. In this exemplary embodiment, the expandable component 144 shown in FIGS. 1A-1B can expand to fix the hybrid bridge plug 100 in place. Alternatively, the expandable annular seal 312 shown in FIG. 6 can expand to fix the hybrid bridge plug 300 in place or the expandable component 704 shown in FIG. 10A can expand to fix the hybrid bridge plug 700 in place.

Upon completion of step 902, a fracking operation can occur. Alternatively, steps 901 and 902 can be repeated, so that an additional hybrid bridge plug can be deployed at a predetermined distance from the hybrid bridge plug 300. In some embodiments, additional plugs are deployed 100 to 500 feet apart from one another. Typically 3-10 fracking operations are performed in a day, so that the hybrid bridge plugs can start to dissolve before the last plug is placed.

Once fracking operations are complete, a plurality of individual hybrid bridge plugs can be positioned at the bottom of a well and, in some embodiments, laying on the bottom surface of the well at predetermined, spaced apart positions and engaging the well surface, so that it is necessary to perform step 903.

At 903, the expandable component is destroyed, at least partially, to allow the bridge plug or bridge plugs to move within the well while maintaining the integrity of continuous fluid channel to allow fluid to flow through the upper end and the lower end. In this exemplary embodiment, the expandable component 144 shown in FIGS. 1A-1B, the expandable annular seal 312 shown in FIG. 6 or the expandable component 704 shown in FIG. 10A can be destroyed. In such embodiments, the integrity of the flow channel 126 shown in FIGS. 4A-4B, the flow channel 310 shown in FIG. 6, and/or the flow channel 710 shown in FIG. 10B remains intact.

At 904, a second tubular bridge plug is inserted into the well to engage the tubular bridge plug. In this exemplary embodiment, the second tubular bridge plug can be the hybrid bridge plug 220 shown in FIG. 5B, the hybrid bridge plug 402 shown in FIG. 7, and/or the hybrid bridge plug 802 shown in FIG. 11.

In some embodiments, additional hybrid bridge plugs can be inserted into the well. Coiled tubing or stick pipe, such as the coiled tube or stick pipe 165 shown in FIG. 2, can be inserted into the well. The coiled tubing or stick pipe can have a receptacle to engage the upper most bridge plug (i.e., the last bridge plug that was inserted will be the first bridge plug retrieved). The hybrid bridge plugs can engage one another to form a plug stack.

At 905, the bridge plugs are pushed to the bottom of the well. In this exemplary embodiment, the hybrid bridge plug can be the hybrid bridge plugs 100, 151-164, 168-170, 200, 220, 300, 400, 402, 600, 618, 700, and 800-808 shown in FIGS. 1A-3, 5A-7, and 9A-11.

Once the plugs are pushed to the bottom of the well (i.e., the rat-hole), the plugs can be released. The coiled tubing or stick pipe can be brought back to surface, which will leave the plugs down the hole. In some embodiments, the plugs can be released using a ball drop mechanism.

Alternatively, at 906, the tubular bridge plugs are raised to the surface of the well. In this exemplary embodiment, the hybrid bridge plug can be the hybrid bridge plugs 100, 151-164, 168-170, 200, 220, 300, 400, 402, 600, 618, 700, and 800-808 shown in FIGS. 1A-3, 5A-7, and 9A-11.

Supported Embodiments

The detailed description provided above in connection with the appended drawings explicitly describes and supports various features of an improved bridge plug in accordance with the described subject matter. By way of illustration and not limitation, supported embodiments include a bridge plug for deployment in a well defined by casing, the bridge plug comprising: a stackable tubular body having a front portion, a middle portion, a back portion, and an internal bore extending therethrough with the front portion having a first opening in fluid communication with the internal bore and the back portion having a second opening in fluid communication with the internal bore; wherein the stackable tubular body has an outer configuration shaped to receive another adjacent bridge plug when the adjacent bridge plug is stacked within the well; wherein the middle portion includes an expandable component that can frictionally engage the casing to hold the bridge plug in a fixed position within the well; and wherein the expandable component can be destroyed, at least partially, to facilitate movement of the bridge plug within the well while maintaining fluid communication between the first opening and the second opening.

Supported embodiments include the foregoing bridge plug, wherein the expandable component can be dissolved, at least partially, to facilitate movement of the bridge plug within the well while maintaining fluid communication between the first opening and the second opening.

Supported embodiments include any of the foregoing bridge plugs, wherein the expandable component includes a brittle material that can be destroyed by mechanical stress.

Supported embodiments include any of the foregoing bridge plugs, wherein the expandable component is a seal.

Supported embodiments include any of the foregoing bridge plugs, further including a plurality of slips for frictionally engaging the well.

Supported embodiments include any of the foregoing bridge plugs, the front portion has an outer configuration shaped to receive a back portion of another adjacent bridge plug when the adjacent bridge plug is stacked within the well.

Supported embodiments include any of the foregoing bridge plugs, the back portion has an outer configuration shaped to receive a front portion of another adjacent bridge plug when the adjacent bridge plug is stacked within the well.

Supported embodiments include any of the foregoing bridge plugs, wherein the back portion includes a latching component and the front portion includes a receptacle for receiving an identical latching component on the adjacent bridge plug.

Supported embodiments include any of the foregoing bridge plugs, wherein the latching component has a tapered profile and the receptacle has an inner chamber contoured to receive the tapered profile of the latching component.

Supported embodiments include any of the foregoing bridge plugs, wherein the front portion includes a latching component and the back portion includes a receptacle for receiving an identical latching component on the adjacent bridge plug.

Supported embodiments include any of the foregoing bridge plugs, wherein the latching component has a tapered profile and the receptacle has an inner chamber contoured to receive the tapered profile of the latching component.

Supported embodiments include any of the foregoing bridge plugs, further comprising a latching mechanism that can be released mechanically or electrically.

Supported embodiments include any of the foregoing bridge plugs, wherein the latching mechanism includes a plurality of spring loaded dogs.

Supported embodiments include any of the foregoing bridge plugs, wherein the seal is made from a metallic material or an elastomeric material.

Supported embodiments include any of the foregoing bridge plugs, wherein the slips are made from a metallic material or an elastomeric material.

Supported embodiments include a method, an apparatus, and/or means for implementing any of the foregoing bridge plugs or portions thereof.

Supported embodiments include a method for using bridge plugs within a well defined by casing, the method comprising: inserting, into the well, a tubular bridge plug having an expandable component positioned between an upper end and a lower end with a continuous fluid channel extending through the upper end and the lower end; expanding the expanding component to engage, frictionally, the casing to fix the bridge plug in place; and destroying the expandable component, at least partially, to allow the bridge plug to move within the well while maintaining the integrity of continuous fluid channel to allow fluid to flow through the upper end and the lower end.

Supported embodiments include the foregoing method, further including: inserting a second tubular bridge plug into the well to engage the tubular bridge plug.

Supported embodiments include any of the foregoing methods, further including: pushing the bridge plugs to the bottom of the well.

Supported embodiments include the foregoing method, further including: raising the tubular bridge plugs to the surface of the well.

Supported embodiments include a system, an apparatus, and/or means for implementing and/or performing any of the foregoing methods or portions thereof.

Supported embodiments include a bridge plug for deployment in a well defined by casing, the bridge plug comprising: an essentially cylindrical body having a first opening at one end, a second opening at the opposite end, an internal chamber in fluid communication with the first opening and the second opening, and an expandable annular ring positioned between the first opening and the second opening; wherein the expandable annular ring can frictionally engage the casing to hold the bridge plug in a fixed position within the well; and wherein the expandable annular ring can be destroyed, at least partially, to facilitate movement of the bridge plug within the well while maintaining fluid communication between the first opening and the second opening.

Supported embodiments include the foregoing bridge plug, wherein the bridge plug is stackable having a receptacle at the one end and a latching mechanism at the opposite end.

Supported embodiments include any of the foregoing bridge plugs, further including a plurality of destroyable slips for frictionally engaging the well.

Supported embodiments include a method, an apparatus, and/or means for implementing any of the foregoing bridge plugs or portions thereof.

Supported embodiments include a kit for assembling a bridge plug, the kit comprising: a stackable tubular body having a front portion, a middle portion, a back portion, and an internal bore extending therethrough with the front portion having a first opening in fluid communication with the internal bore and the back portion having a second opening in fluid communication with the internal bore; wherein the front portion has an outer configuration shaped to receive a back portion of another adjacent bridge plug when the adjacent bridge plug is stacked within the well; wherein the middle portion includes an expandable component that can frictionally engage the casing to hold the bridge plug in a fixed position within the well; and wherein the expandable component can be destroyed, at least partially, to facilitate movement of the bridge plug within the well while maintaining fluid communication between the first opening and the second opening.

Supported embodiments include hybrid bridge plugs that do not contain a latching mechanism.

Supported embodiments include a hybrid bridge plug that includes a latching mechanism that is mechanically or electronically released, including a latching mechanism that is released with a ball drop.

Supported embodiments include a hybrid bridge plug that includes slips that are made, partially, of dissolvable material, in which sufficient material is dissolved such that slips lose integrity while the non-dissolvable material of the slips can be circulated back to surface.

Supported embodiments include a hybrid bridge plug that includes slips and/or elastomers that are made of a material that dissolves when put in contact with a reactive substance such as acid. In such embodiments, tubing can latch into a plug, circulate reactive fluid to break down slips and elements, and continue on to next plug after fracturing operations are complete.

Supported embodiments include embodiments having hybrid bridge plugs that include slips that are made of a brittle material that shatters at a predetermined time after fracturing operations have begun or have been completed.

Supported embodiments include methods in which hybrid bridge plugs are pushed to the bottom of a well.

Supported embodiments include methods in which hybrid bridge plugs are pulled out of well to the surface.

Supported embodiments include methods in which hybrid bridge plugs or hybrid bridge plug cores are brought to surface for re-use in future applications. In such embodiments, the hybrid bridge plug core can be made of low cost material, such as cast iron.

Supported embodiments include methods in which hybrid bridge plugs are pushed to the bottom of a well and anchored in toe. In some embodiments, the hybrid bridge plug can be anchored in to using an additional plug or other anchoring device.

Supported embodiments include methods in which some hybrid bridge plugs are brought to the surface of a well and other hybrid bridge plugs are pushed to the bottom of the well. In some embodiments, the hybrid bridge plugs can be moved in multiple trips.

Supported embodiments include hybrid bridge plugs that are equipped with pressure, temperature, or other environmental sensors that can be brought to a well surface with the plug.

Supported embodiments can provide various attendant and/or technical advantages in terms of improved efficiency and/or savings. By way of illustration and not limitation, various features and implementations in accordance with the described subject matter offer many benefits, which include the ability to stack bridge plugs within a well in order to facilitate clean-up. In some embodiments, the plugs can be pulled through the well to be "re-built" later with new dissolving slips and seals. In other embodiments, the plugs can be pushed to the bottom (or into a "rat hole") of the well for release. In such embodiments, the plugs can be locked into place. In other embodiments, a hybrid bridge plug can be made from low cost materials and can be removed from a well without performing "drill-out" operations. In other embodiments, the use of certain hybrid plug materials can reduce the time associated with "drill-out" operations from days to hours.

Supported embodiments can include hybrid bridge plugs that can be stacked to form a flow channel extending therethrough. In such embodiments, acids, friction reducers, and/or gels can be circulated through the flow channel to prevent the plugs from being stuck or to free plugs that have been stuck.

Supported embodiments include the use of a disconnect device to pull tubing out of hole. In such embodiments, the hybrid bridge plugs are left behind, so that normal drilling operations can continue.

Supported embodiments can provide a significant reduction in drill out costs, time, and/or chemicals.

Supported embodiments can implement plugs that are relatively inexpensive to manufacture because the plug body can be made of low cost material, such as cast iron (no need for composite if plug is not being drilled out). Additionally, plugs can include dissolving elements that represent a very small percentage of plug material (5-20%). Moreover, the plug body can be re-used in some embodiments.

Supported embodiments can further reduce costs because in some operations, the operator merely has to wait for the dissolving elements to dissolve in order to free stuck plugs. However, in some embodiments, it may be necessary to perform "drill-out" operations to free stuck hybrid bridge plugs, but the energy utilized in such "drill-out" operations can be reduced through the use of the non-dissolving components to be created from composite material.

Supported embodiments include a hybrid bridge plug concept that can be adapted to most conventional plug designs, so that operators will be comfortable with the base design.

Supported embodiments include hybrid bridge plugs in which reactive fluid, heated water, and/or brine can be circulated or re-circulated to enable/enhance dissolution of reactive material.

Supported embodiments can utilize a semi-dissolvable "frac ball" that allows a core to flow back to a well surface through a plug stack to reduce the amount of dissolvable material that is required.

The detailed description provided above in connection with the appended drawings is intended as a description of examples and is not intended to represent the only forms in which the present examples can be constructed or utilized.

It is to be understood that the configurations and/or approaches described herein are exemplary in nature, and that the described embodiments, implementations and/or examples are not to be considered in a limiting sense, because numerous variations are possible. The specific processes or methods described herein can represent one or more of any number of processing strategies. As such, various operations illustrated and/or described can be performed in the sequence illustrated and/or described, in other sequences, in parallel, or omitted.

Although the subject matter has been described in language specific to structural features and/or methodological acts, it is to be understood that the subject matter defined in the appended claims is not necessarily limited to the specific features or acts described above. Rather, the specific features and acts described above are presented as example forms of implementing the claims.

What is claimed is:

1. A bridge plug for deployment in a well defined by casing, the bridge plug comprising:

a stackable tubular body having a front portion, a middle portion, a back portion, and an internal bore extending therethrough with the front portion having a first opening in fluid communication with the internal bore and the back portion having a second opening in fluid communication with the internal bore;

wherein the stackable tubular body has an outer configuration shaped to receive another adjacent bridge plug when the adjacent bridge plug is stacked within the well;

wherein the middle portion includes an expandable component that can frictionally engage the casing to hold the bridge plug in a fixed position within the well; and wherein the expandable component can be destroyed, at least partially, to facilitate movement of the bridge plug within the well while maintaining fluid communication between the first opening and the second opening.

2. The bridge plug of claim 1, wherein the expandable component can be dissolved, at least partially, to facilitate movement of the bridge plug within the well while maintaining fluid communication between the first opening and the second opening.

3. The bridge plug of claim 1, wherein the expandable component includes a brittle material that can be destroyed by mechanical stress.

4. The bridge plug of claim 1, wherein the expandable component is a seal.

5. The bridge plug of claim 4, further including a plurality of slips for frictionally engaging the well.

6. The bridge plug of claim 1, wherein the front portion has an outer configuration shaped to receive a back portion of another adjacent bridge plug when the adjacent bridge plug is stacked within the well.

7. The bridge plug of claim 1, wherein the back portion has an outer configuration shaped to receive a front portion of another adjacent bridge plug when the adjacent bridge plug is stacked within the well.

8. The bridge plug of claim 1, wherein the back portion includes a latching component and the front portion includes a receptacle for receiving an identical latching component on the adjacent bridge plug.

9. The bridge plug of claim 8, wherein the latching component has a tapered profile and the receptacle has an inner chamber contoured to receive the tapered profile of the latching component.

10. The bridge plug of claim 1, wherein the front portion includes a latching component and the back portion includes a receptacle for receiving an identical latching component on the adjacent bridge plug.

11. The bridge plug of claim 8, wherein the latching component has a tapered profile and the receptacle has an inner chamber contoured to receive the tapered profile of the latching component.

12. The bridge plug of claim 1, further comprising a latching mechanism that can be released mechanically or electrically.

13. The bridge plug of claim 12, wherein the latching mechanism includes a plurality of spring loaded dogs.

14. A method for using bridge plugs within a well defined by casing, the method comprising:

inserting, into the well, a tubular bridge plug having an expandable component positioned between an upper end and a lower end with a continuous fluid channel extending through the upper end and the lower end;

expanding the expanding component to engage, frictionally, the casing to fix the bridge plug in place; and destroying the expandable component, at least partially, to allow the bridge plug to move within the well while maintaining the integrity of continuous fluid channel to allow fluid to flow through the upper end and the lower end.

15. The method of claim 14, further including:

inserting a second tubular bridge plug into the well to engage the tubular bridge plug.

16. The method of claim 15, further including:

pushing the bridge plugs to the bottom of the well.

17. The method of claim 15, further including:

raising the tubular bridge plugs to the surface of the well.

18. A bridge plug for deployment in a well defined by casing, the bridge plug comprising:

an essentially cylindrical body having a first opening at one end, a second opening at the opposite end, an internal chamber in fluid communication with the first opening and the second opening, and an expandable annular ring positioned between the first opening and the second opening;

wherein the expandable annular ring can frictionally engage the casing to hold the bridge plug in a fixed position within the well; and wherein the expandable annular ring can be destroyed, at least partially, to facilitate movement of the bridge plug within the well while maintaining fluid communication between the first opening and the second opening.

19. The bridge plug of claim 18, wherein the bridge plug is stackable having a receptacle at the one end and a latching mechanism at the opposite end.

20. The bridge plug of claim 18, further including a plurality of destroyable slips for frictionally engaging the well.

* * * * *